United States Patent [19]

Popp

[11] 4,363,334

[45] Dec. 14, 1982

[54] COMBING CURLER

[75] Inventor: Frank Popp, Niefern-Öschelbronn, Fed. Rep. of Germany

[73] Assignee: Forfex Alfred Popp Haarpflegegerate GmbH, Niefern-Öschelbronn, Fed. Rep. of Germany

[21] Appl. No.: 287,787

[22] Filed: Jul. 28, 1981

[30] Foreign Application Priority Data

Aug. 5, 1980 [DE] Fed. Rep. of Germany ..... 3029619

[51] Int. Cl.[3] ..... A45D 2/12

[52] U.S. Cl. ..... 132/33 R

[58] Field of Search ..... 132/11 R, 40, 37 R, 132/42, 38–39

[56] References Cited

U.S. PATENT DOCUMENTS

| | | | |
|---|---|---|---|
| 2,443,729 | 6/1948 | Giarratano | 132/33 R |
| 3,148,685 | 9/1964 | Haynes et al. | 132/33 R |
| 3,260,269 | 7/1966 | Zurndorfer | 132/33 R |
| 4,031,907 | 6/1977 | Rogers | 132/40 |

*Primary Examiner*—G. E. McNeill

*Attorney, Agent, or Firm*—Balogh, Osann, Kramer, Dvorak, Genova & Traub

[57] ABSTRACT

A dressing comb extends longitudinally in a curler tube and has teeth adapted to protrude through a longitudinal slot of the curler tube. Advancing spring means are accommodated in said curler tube and urge said dressing comb to a position in which said teeth protrude from said slot. Said teeth are adapted to be entirely retracted into said curler tube against the force of said advancing spring means. A clamping comb is provided, which extends longitudinally in said curler tube and parallel to said dressing comb and has teeth adapted to protrude through said slot and is urged by said advancing spring means to a position in which the teeth of said clamping comb are adapted to be entirely retracted into said curler tube against the force of said advancing spring means.

17 Claims, 4 Drawing Figures

24
2
3
18
19
7
17
17a
12
B
5
13
20
6
8
14
15a
9a
10
9
11
1

24
23
2
4
3
18
19
7
17
12
17a
20
5
13
6
14
8
15a
16
16a
1
9a
15
14
10
9
11

COMBING CURLER

This invention comprises a combing curler comprising a curler tube having a slot and a dressing comb which is adapted to be retracted against spring action through said slot into the curler tube.

In known combing curlers of that kind, the dressing comb is adapted to be entirely retracted into the curler tube. Such combing curlers serve to comb the hair and then to curl the hair and the dressing comb which has been entirely introduced into the curler tube can be pulled out of the ringlet of hair. Such a combing curler is shown, e.g., in German Utility Model Specification No. 74 42 661. In the use of that combing curler the dressing comb may fail to entrain the hair to be curled from the tips so that the hair is not completely curled. Besides, the dressing comb of the known combing curlers is pivotally retracted by the actuation of a pushbutton before the combing curler can be pulled out of the ringlet of hair and this pivotal retraction of the dressing comb is not reliably performed in every rotational position of the combing curler.

It is an object of the invention to eliminate these disadvantages and to ensure that the hair will be satisfactorily curled from the tips and also to permit a pivotal retraction of the dressing comb by a convenient operation regardless of the rotational position of the combing curler assembly.

To accomplish that object, a combing curler comprising a curler tube having a slot and a dressing comb which is adapted to be retracted against spring action through said slot into the curler tube is characterized in accordance with the invention by the provision of a clamping comb, which is parallel to the dressing comb and is longitudinally slidable relative thereto and has teeth which are set back from the teeth of the dressing comb, the dressing comb is pivoted to a handle secured to the curler tube and is pivotally movable to move its teeth out of the slot in the curler tube, the teeth of the dressing comb increase in length toward the free end of the curler tube, the dressing comb is adapted to be pivotally retracted into the curler tube by means of a slide ring, which is slidably mounted on the curler tube and engages the dressing comb at a beveled surface thereof, which protrudes from the slot in the curler tube, and a bent spring engages the back of the dressing comb and opposes the pivotal retraction thereof into the curler tube. In this arrangement, the hair is clamped at its very tips so that they will be reliably entrained by the dressing comb for the curling movement and the dressing comb can easily be pivotally retracted regardless of the rotational position of the combing curler.

The clamping comb may be mounted on the dressing comb to be longitudinally slidable relative thereto within limits by means of a longitudinal guide slot and a boss extending into said guide slot so that the clamping comb is longitudinally slidable relative to the dressing comb against the force of a spring. Respective halves of a spring chamber accommodating said spring may be formed in the dressing comb and the slidably mounted clamping comb.

Further details of the combing curler according to the invention are apparent from the drawing, which shows a preferred embodiment.

Figure 1:
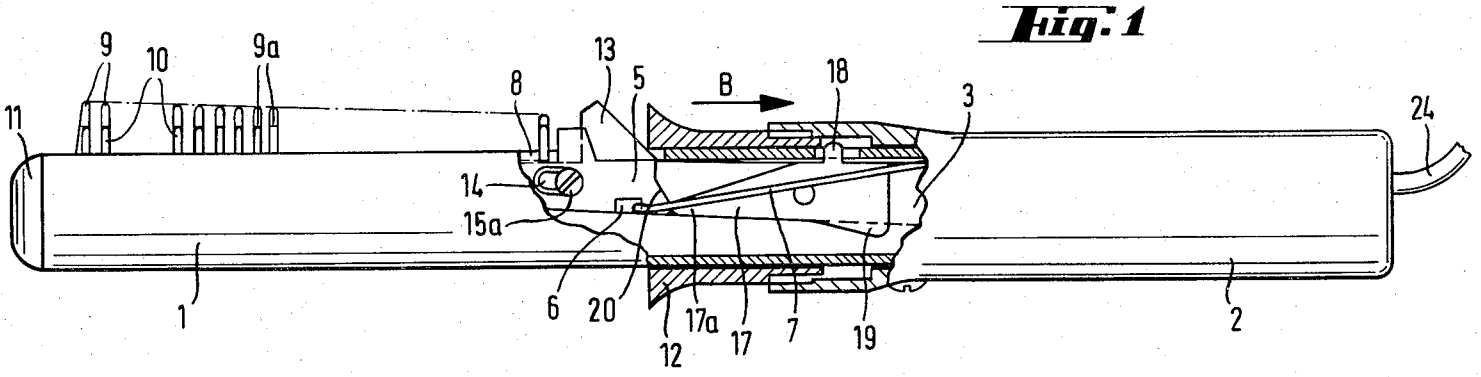
FIGS. 1 to 3 are longitudinal sectional views showing a combing curler with the dressing and clamping combs in a normal position, in a clamping position and in a position in which the combs are retracted in the curler tube, respectively.

As is apparent from the drawing, the combing curler assembly comprises a curler tube 1, which is secured to a handle 2, also a dressing comb 3, which has teeth 9 and is pivoted at 4 to the handle 2, and a clamping comb 5, which has teeth 10 and is longitudinally slidable on the dressing comb 3. A bent advancing spring 7 is provided, which engages the back of the dressing comb 3 at 6 and biases the dressing and clamping combs 3 and 5 so that their teeth 9, 10 tend to protrude outwardly through a slot 8 of the curler tube 1. The teeth 9 are longer than the teeth 10 so that the latter are set back from the teeth 9. The teeth 9 and, if desired, the teeth 10, increase in length toward the free end 11 of the curler tube. The teeth 9 extend in part over the teeth 10, as is indicated at **9*a* in FIG. 4**.

Figure 2:
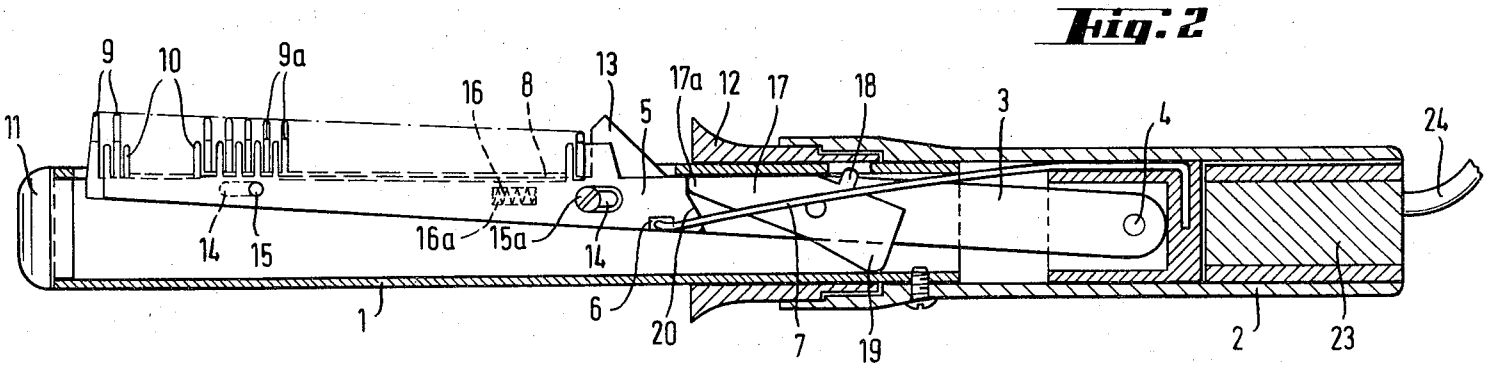
Figure 3:
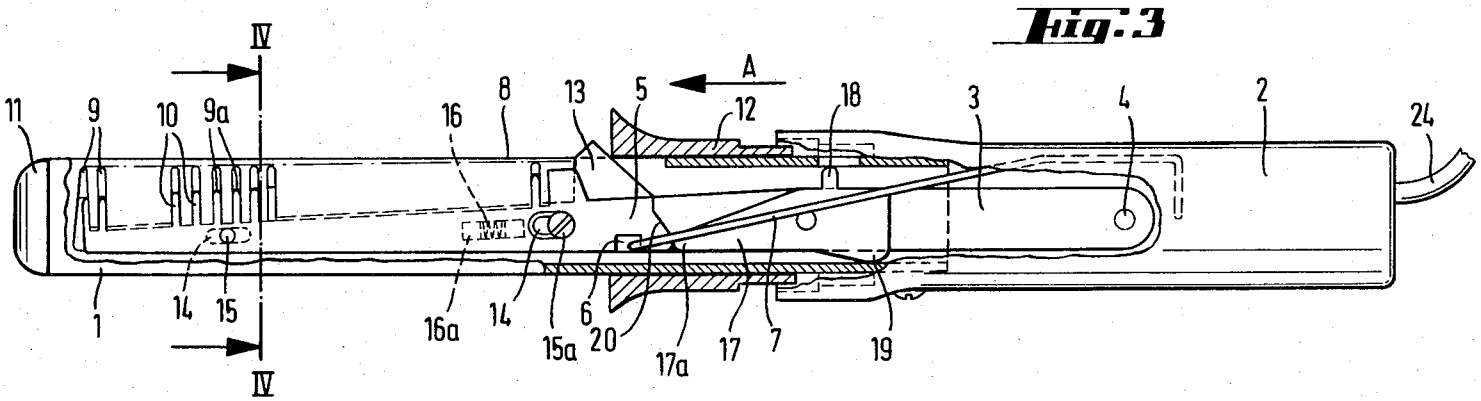

A slide ring 12 is slidably mounted on the curler tube 1 and at one end extends under the handle 2. Because this sliding member is annular, it can be operated regardless of the rotational position of the combing curler. When the slide ring 12 is moved in the direction A in FIG. 3, the slide ring 12 will engage a beveled rear surface of a cam 13, which is formed on the dressing comb 3 and protrudes from the slot 8, so that the teeth 9, 10 are pivotally retracted into the curler tube 1. The clamping comb 5 is slidably mounted on the dressing comb 3 by means of two longitudinally spaced apart longitudinal guide slots 14 and two bosses 15, each of which extends into one of said slots 14. In the present embodiment, one slot is formed in the dressing comb 3 and the other in the clamping comb 5 and the associated bosses are formed on the clamping comb 5 and the dressing comb 3, respectively. Alternatively, both slots 14 may be formed in one comb, preferably the dressing comb 3, and the bosses will then be formed on the other comb, preferably the clamping comb 5. To hold each boss 15 captive in the guide slot 14, each boss 15 accommodates a tapped sleeve (not shown), into which a retaining screw **15*a* is screwed, the head of which is accommodated in the slot 14, which for this purpose has a wider portion. In another alternative embodiment, the boss consists only of such tapped sleeve, which is embedded in the plastic comb as it is molded. If the combs consist of metal, the boss 15 may be constituted by the shank of the retaining screw 15*a*, which in that case is screwed into a tapped hole formed in the comb. The clamping comb 5 is biased by a clamping spring 16, which is accommodated in a spring chamber that is formed in both combs 3, 5. Behind the slidable clamping comb 5, a two-armed lever 17 is pivoted to the dressing comb 3. The rear arm of the lever 17 carries a cam 18, which is engageable by the slide ring 12 as the latter is retracted in the direction of the arrow B in FIG. 1 so that the forward arm 17*a* of the lever 17 releases the clamping comb 5, which can now be moved to its clamping position, shown in FIG. 2, by the spring 16. To return the slidable clamping comb 5 from its clamping position to the normal position shown in FIG. 1, the retracting movement of the combs 3 and 5 to the position shown in FIG. 3 will cause the cam 19 at the lower edge of the rear arm of the lever 17 to engage the bottom of the curler tube 1 so that the forward arm 17*a* of the lever 17 will engage and slide along the beveled edge face 20 at the rear end of the clamping comb 5 to advance the latter. At the same time, the lever 17 is returned to its locking position, shown in FIG. 1**.

In the position shown in FIG. 1, the combing curler can be used to comb the hair. If the slide ring 12 is moved in the direction of the arrow B, the combing curler will assume the position shown in FIG. 2 so that the tips of the hair are clamped and can then be curled. When the slide ring 12 is subsequently moved in the direction of the arrow A to the position shown in FIG. 3, the combs 3 and 5 are retracted so that the curler tube 1 can be pulled out of the ringlet to which the hair has been formed.

Figure 4:
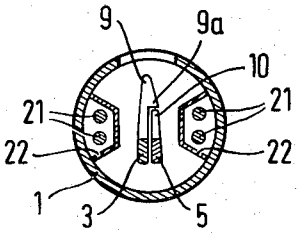
FIG. 4 is a transverse sectional view taken on line IV—IV in FIG. 3.

The curler tube 1 may accommodate heating means consisting of heating wires 21 and covers 22 and disposed on opposite sides of the combs 3 and 5, as is shown in FIG. 4. Said heating means are powered from a power source, which is connected to the heating means by a lead 24 and a rotary contact 23 provided in the rear end portion of the tubular handle 2 secured to the curler tube 1.

If the combing curler is heatable, the combs 3 and 5 consist of metal, otherwise they are suitably made of plastic material.

What is claimed is:

1. In a combing curler comprising a curler tube formed with a longitudinal slot, a dressing comb extending longitudinally in said curler tube and having teeth adapted to protrude through said slot, and advancing spring means accommodated in said curler tube and urging said dressing comb to a position in which said teeth protrude from said slot, said teeth being adapted to be entirely retracted into said curler tube against the force of said advancing spring means, the improvement residing in that a clamping comb is provided, which extends longitudinally in said curler tube and parallel to said dressing comb and has teeth adapted to protrude through said slot and is urged by said advancing spring means to a position in which the teeth of said clamping comb protrude from said slot, and said teeth of said clamping comb are adapted to be entirely retracted into said curler tube against the force of said advancing spring means.

2. The improvement set forth in claim 1, wherein said curler tube defines for said dressing and clamping combs an outermost position in which said teeth of said dressing comb protrude beyond said teeth of said clamping comb.

3. The improvement set forth in claim 1, wherein a handle is secured to one end of said curler tube, said dressing comb is pivoted to said handle and said clamping comb is longitudinally slidably mounted on said dressing comb.

4. The improvement set forth in claim 3, wherein said teeth of said dressing comb increase in length toward the opposite end of said curler tube.

5. The improvement set forth in claim 4, wherein the teeth of said clamping comb increase in length toward the opposite end of said curler tube.

6. The improvement set forth in claim 3, wherein said dressing comb carries a cam, which protrudes from said slot and has a beveled surface, which faces said handle and is spaced therefrom and a slide ring is slidably mounted on said curler tube between said cam and said handle and is slidable toward the opposite end of said curler tube to engage said beveled surface and thus to retract said teeth of said dressing and clamping combs into said curler tube.

7. The improvement set forth in claim 1, wherein one of said combs is formed with a longitudinal guide slot, the other of said combs carries a projection extending into said guide slot whereby said clamping comb is mounted on said dressing comb for a limited longitudinal sliding movement, said projection is arranged to engage one end of said guide slot in a clamping position, in which the teeth of said clamping comb register with the teeth of said dressing comb, and to engage the other end of said guide slot in a non-clamping position, in which the teeth of said clamping comb are longitudinally spaced from the teeth of said dressing comb, clamping spring means are provided, which urge said clamping comb toward said clamping position, and retaining means are provided, which hold said projection captive in said guide slot.

8. The improvement set forth in claim 7, wherein said retaining means comprise a head of a screw, which is screwed into the comb carrying said projection and said head is accommodated in said guide slot.

9. The improvement set forth in claim 7, wherein said projection consists of a boss and said retaining means comprise a screw, which is screwed into said boss and has a head accommodated in said guide slot.

10. The improvement set forth in claim 9, wherein two of said guide slots are provided, which are longitudinally spaced apart, and two of said projections are provided, which extend into respective ones of said guide slots.

11. The improvement set forth in claim 10, wherein each of said combs is formed with one of said guide slots and carries one of said projections.

12. The improvement set forth in claim 7, wherein said dressing comb and said clamping comb are formed with respective recesses, which are open into each other to form a spring chamber and said clamping spring means comprise a clamping spring accommodated in said spring chamber.

13. The improvement set forth in claim 1, wherein said curler tube is formed with an aperture which is longitudinally aligned with said slot, said clamping comb is mounted on said dressing comb and slidable along the same between a clamping position, in which the teeth of said clamping comb register with the teeth of said dressing comb, and a non-clamping position, in which the teeth of said clamping comb are longitudinally spaced from the teeth of said dressing comb, clamping spring means are provided, which urge said clamping comb toward said clamping position, said dressing comb has an end portion which protrudes longitudinally from said clamping comb, a two-armed lever is pivoted to said end portion and has a forward arm engageable with said clamping comb and a rear arm carrying a cam, which is adapted to protrude through said aperture, said two-armed lever is pivotally movable between a first position in which said cam protrudes through said aperture and said forward arm engages said clamping comb and holds the same in said non-clamping position against the action of said clamping spring means, and a second position in which said cam is retracted into said curler tube and said forward arm permits said clamping spring means to move said clamping comb to said clamping position, said clamping spring means are adapted to hold said two-armed lever in said first position by the frictional engagement of said clamping comb with said forward arm with said clamping lever when the latter is in said non-clamping position, and a slide ring is slidably mounted on said curler tube and movable along the same between a first position in which said slide ring exposes said aperture and a second position in which said slide ring covers said aperture and holds said cam retracted in said curler tube.

14. The improvement set forth in claim 13, wherein a handle is secured to one end of said curler tube, said dressing comb is pivoted to said handle, said dressing comb has a cam, which protrudes from said slot and has a beveled surface which faces said handle and is spaced therefrom and said slide ring is mounted on said curler tube between said cam and said handle and is slidable toward said one end of said curler tube to cover said aperture and toward the opposite end of said curler tube to engage said beveled surface and thus to retract said teeth of said dressing and clamping combs into said curler tube.

15. The improvement set forth in claim 13, wherein a handle is secured to one end of said curler tube, said dressing comb is pivoted to said handle and is pivotally movable to retract said teeth of said dressing and clamping combs into said curler tube, said clamping comb has a beveled end face facing said first arm of said two-armed lever and said two-armed lever when in said second position is arranged to engage with its rear arm said curler tube at a portion thereof which is diametrically opposite to said aperture and to be pivotally moved to said first position with said forward arm sliding along said beveled end face in response to a pivotal movement of said dressing comb to retract said teeth of said dressing and clamping combs into said curler tube.

16. The improvement set forth in claim 1, wherein said curler tube accommodates heating means on opposite sides of said dressing and clamping combs.

17. The improvement set forth in claim 16, wherein a tubular handle is secured to said curler tube, and said tubular handle accommodates a rotary contact electrically connected to said heating means and adapted to be electrically connected to an electric power source.

* * * * *